United States Patent [19]

Gronlie et al.

[11] Patent Number: 5,052,169

[45] Date of Patent: Oct. 1, 1991

[54] PACKING ARRANGEMENT FOR FILLING OF FREE-FLOWING MATERIALS

[75] Inventors: Odd Gronlie, Nesbru; Knut Ihle, Oslo; John Eilertsen, Porsgrunn; Tor Bergli, Oslo, all of Norway

[73] Assignee: Norsk Hydro a.s., Oslo, Norway

[21] Appl. No.: 469,607

[22] PCT Filed: Aug. 16, 1989

[86] PCT No.: PCT/NO89/00082

§ 371 Date: Jun. 4, 1990

§ 102(e) Date: Jun. 4, 1990

[87] PCT Pub. No.: WO90/02081

PCT Pub. Date: Mar. 8, 1990

[30] Foreign Application Priority Data

Aug. 16, 1988 [NO] Norway ..... 883739

[51] Int. Cl.[5] ..... B65B 1/32; B65B 1/06

[52] U.S. Cl. ..... 53/502; 53/284.7

[58] Field of Search ..... 53/502, 437, 525, 167, 53/284.7, 266.1; 493/478, 479, 477; 141/10, 114, 68, 67, 316, 315, 314

[56] References Cited

U.S. PATENT DOCUMENTS

| | | | |
|---|---|---|---|
| Re. 32,798 | 12/1988 | Van Der Wal et al. | 53/502 X |
| 2,343,879 | 3/1944 | Belcher et al. . | |
| 2,869,296 | 1/1959 | Overman | 53/502 |
| 4,074,507 | 2/1978 | Ruf et al. | 53/502 |
| 4,688,371 | 8/1987 | Hecht | 53/502 |
| 4,703,782 | 11/1987 | Henkel, Sr. | 141/65 |
| 4,724,656 | 2/1988 | Tanaka | 53/502 |

FOREIGN PATENT DOCUMENTS

| | | |
|---|---|---|
| 0067064 | 12/1982 | European Pat. Off. . |
| 2116839 | 5/1972 | Fed. Rep. of Germany . |
| 3241917 | 5/1984 | Fed. Rep. of Germany . |
| 69992 | 1/1986 | Finland . |
| 7723697 | 7/1977 | France . |

*Primary Examiner*—James F. Coan

*Attorney, Agent, or Firm*—Wenderoth, Lind & Ponack

[57] ABSTRACT

An apparatus for bagging free-flowing material in bags and sealing of such filled bags includes a receiving system for intermediate storage of the material, at least one device or system for weighing and filling of the material, at least one system for transport of the filled bags and at least one bag sealing machine. The systems for weighing and filling of the materials and the transport systems and the sealing systems are arranged in a common frame. The weighing and filling system is movable from a position inside the frame to a position partly or completely outside the frame. The receiving system is supported independently with respect to the frame and is adjustable in the vertical direction. The receiving system may be connected to the weighing and filling system by a flexible coupling, thus preventing transmission of vibrations and shocks from the receiving system to the frame and the weighing and filling system.

15 Claims, 2 Drawing Sheets

PACKING ARRANGEMENT FOR FILLING OF FREE-FLOWING MATERIALS

BACKGROUND OF THE INVENTION

The present invention relates to a bagging apparatus for bagging free-flowing material into bags and for sealing such filled bags, such apparatus including means for receiving and temporarily storing the material, at least one apparatus for weighing and filling the material into a bag, at least one system for transport of the bagged material, and means for closing of such filled bag.

There has been known for a long time a movable apparatus for bagging of free-flowing material such as fertilizer and grain. The material is transported in bulk overseas to remote locations. Normally, the bulk material is discharged from a docked ship by using a mechanical grab. The free-flowing material is supplied to hoppers or silos for storage, located at a quay or nearby the docked ship.

The hoppers of well known bagging plants are made very robust and have coarse grating enabling the grab to crush any lumps of the material. Bagging is achieved by reliable volume packers located directly below the topper. The packers can be used for packing of open bags, but also for valved bags if the headroom below the hopper is increased by redesigning the construction of the hopper. This however represents a large and costly operation. Volume packers are used for bagging because they are reliable under the harsh bagging environment including vibrations, humidity, dust and temperature differences. These packers however have one main disadvantage involving inaccuracy during bagging. Such inaccuracy may be 300 gram per bag when bagging 50-litre bags. This adds up to several hundred tons per shipload. A second disadvantage of known mobile packers involves the open conditions of the supply piping with respect to static electricity and air, wherein the apparatus is unattached and unsecured and results in environment problems and production losses.

In Norwegian Patent No. 156,324 (corresponding to EP Patent No. 0,067,064) there is disclosure a mobile bagging apparatus where two containers are used for bagging free-flowing material. One upper container made according to standard dimensions comprises a silo for receiving the material, and it is fastened to a lower container which forms the bagging apparatus proper. Such apparatus has concentrated on providing a system that can be transported by a container-ship, rather than solving the problems related to bagging by a mobile bagging apparatus. Such apparatus, because of the low headroom in the container, can be used only for bagging open bags, and further it has room or space only for one bagging run. Such solution inherently has restricted use and low production capacity.

Also, because the upper container rests on the lower container, vibrations and shocks from the discharging apparatus will be transmitted to the lower container that includes the weighing equipment. Such vibrations and shocks are harmful to the weighing equipment and will disrupt the accuracy thereof. Thus, a mechanical weighing apparatus without electronic control is used. However, such a mechanical weighing apparatus has low accuracy and capacity, and this increases the drawback of such known system.

SUMMARY OF THE INVENTION

The object of the present invention is to design a bagging apparatus with a high production capacity and which can be used for bagging both open bags and valved bags. A further object of the invention is to employ an electrical weighing apparatus to increase accuracy and thus to reduce the economic loss resulting from an inaccurate weighing apparatus. It also is an object of the invention to provide such an apparatus that is environmentally sound and that is as compact as possible to simplify transportation from one location to another.

According to the invention there is provided a bagging apparatus wherein means for weighing and filling of material, the means for transporting the filled bags and closing means are located in the same frame construction. The weighing and filling means is height adjustable from a position partly or completely outside the frame construction. The receiving equipment is freely supported with regard to the frame construction and is adjustable in the vertical direction. The frame construction may be connected to the loading equipment by a flexible connection or the like to avoid transmission of vibrations and shocks from loading equipment to the frame construction.

Sufficient space to contain two parallel bagging runs is provided by making the weighing and filling means adjustable in the vertical direction. This doubles the packing capacity and also provides space for bagging of valved bags by using extra equipment.

Further, because the weighing equipment is freely supported with regard to the frame construction and a flexible connection is used between the weighing apparatus and the loading equipment, it is possible to use electronic weights for measuring the bagged material. Also, a second space or room is provided in the frame construction for necessary cooling of the electronic system.

When the bagging apparatus is idle, the weighing and filling means can be lowered into the frame construction, covered and locked. Thus the frame construction, housing all the equipment, provides a compact unit which requires a small area and is simple and inexpensive to transport from one location to another.

BRIEF DESCRIPTION OF THE DRAWINGS

A better understanding of the invention will be obtained from the following description, by way of example only, with reference to the accompanying drawings, wherein.

DETAILED DESCRIPTION OF THE INVENTION

Figure 1:
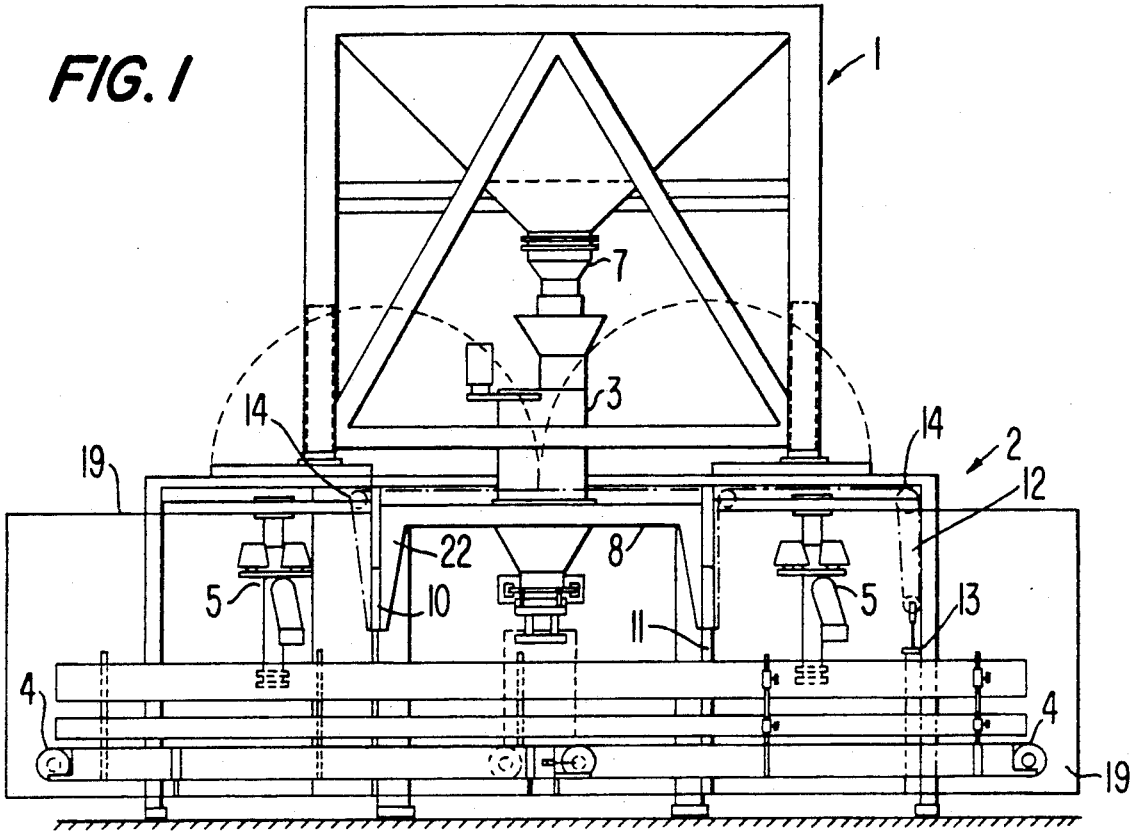
FIG. 1 is a side view of a bagging plant for open bags.
Figure 2:
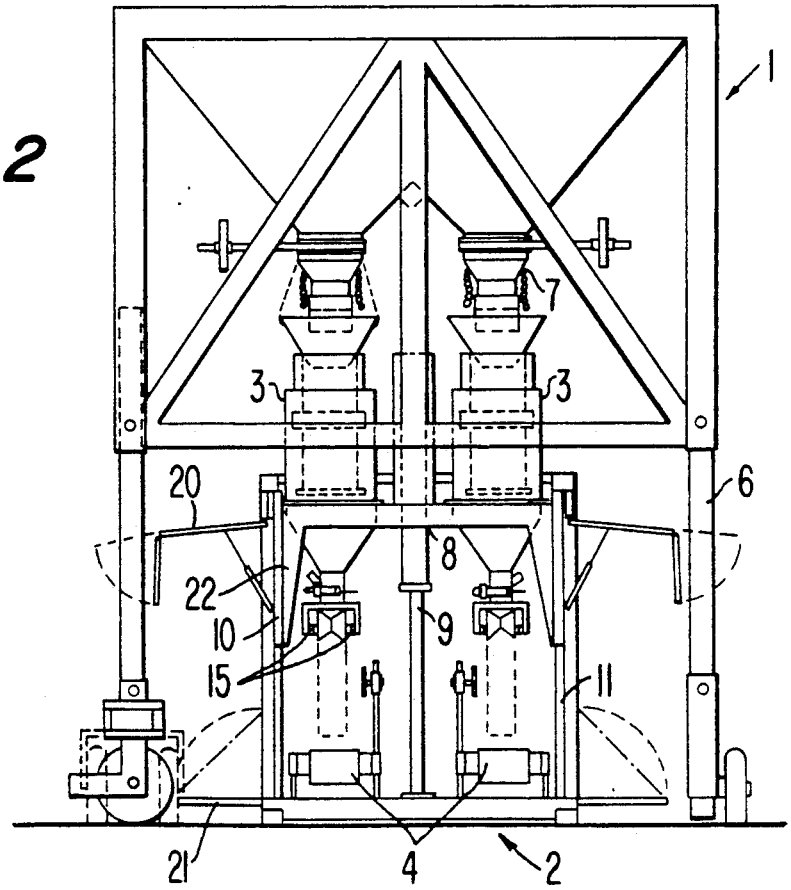
FIG. 2 is an end view of the bagging plant.

FIGS. 1 and 2 illustrate a bagging plant for the bagging of open bags. The bagging plant comprises a receiver or receiving system or assembly 1 in the form of a hopper for intermediate storage of free-flowing material, two devices or assemblies 3 for weighing and filling of bagged material, two systems or assemblies for transporting filled bags and comprising two conveyors 4, such as belt conveyors, and two machines or assemblies 5 for sealing the bags. The weighing and filling devices 3, the transportation systems 4 and the sealing machines 5 are located in a frame or framelike construction 2 which is located below the receiver 1.

The receiver 1 is supported on telescopic legs 6 separated from the frame 2 to prevent transmission of vibrations and shocks to the weighing devices. Further, if the receiver 1 is connected to the weighing and filling devices, such connection is by flexible coupling means 7 to prevent transmission of vibrations from the hopper to the framelike construction. This allows very accurate electronic weighing devices to be used in the bagging apparatus. The receiver 1 does not have to be movable or have telescopic legs. It is possible within the scope of the invention to use a permanent receiver or hopper. However, the receiver must have an outlet at a sufficient height above the ground. Also, if the receiver has a connection 7, it needs to be adjustable in the longitudinal direction so that the weighing and filling devices can be fed and if necessary be used for packing of open bags and valved bags.

The weighing and filling system includes two separate devices or units 3, and they are mounted in a solid rectangular support frame 8 which is height adjustable relative to framelike construction 2 by the guides 10, 11 located at each corner of the support frame. Each guide comprises a casing or pipe 10 which is connected to the frame 8 and which can move along a vertical column 11. The columns 11 preferably extend throughout the total height of the framelike construction 2, and opposite ends of each column are mounted in the top and bottom of the framelike construction 2. As will be apparent from the drawings, the casings 10 are mounted on legs 22 which protrude downwardly from the corners of the frame 8. This enables the frame 8 to be moved from a lower position where it is housed within the framelike construction 2, to an upper position which it is in use where it is just inside or above the top part of the framelike construction.

Figure 3:
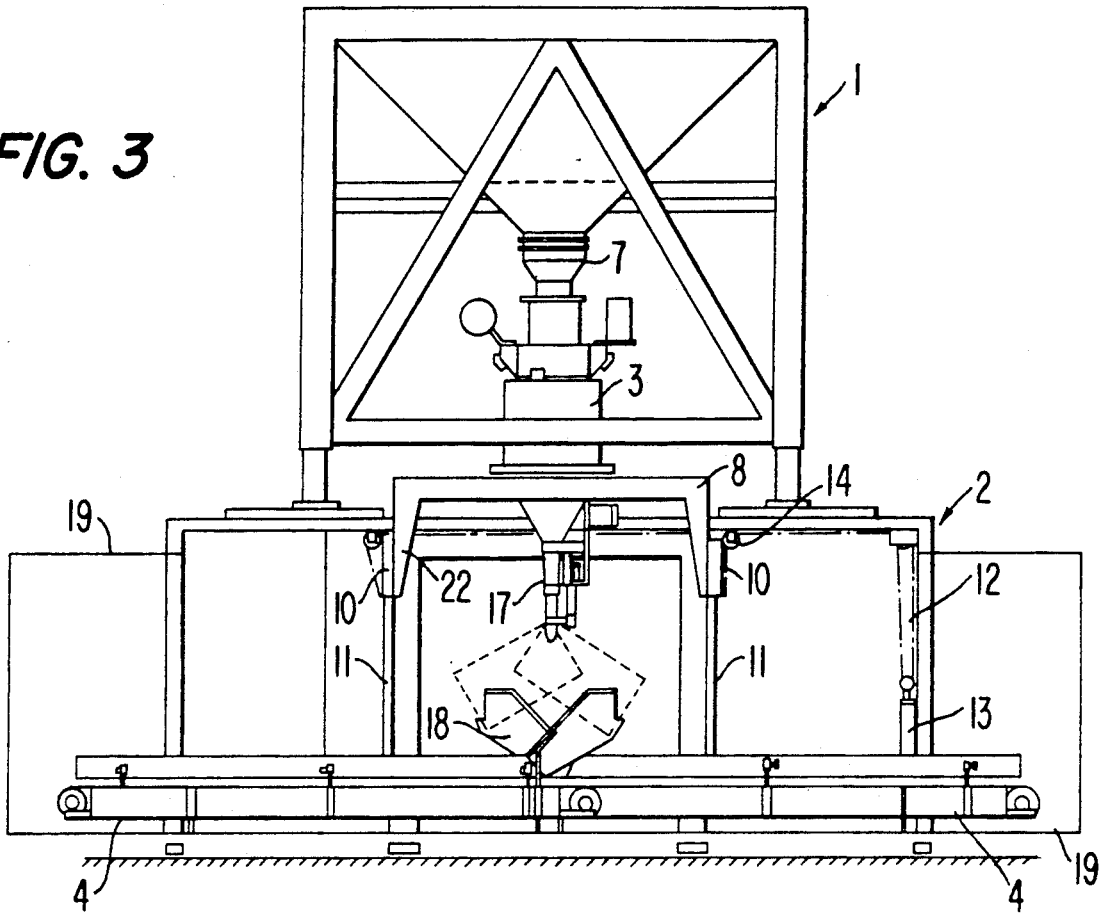
FIG. 3 is a side view of a modified bagging plant for bagging of valved bags.
Figure 4:
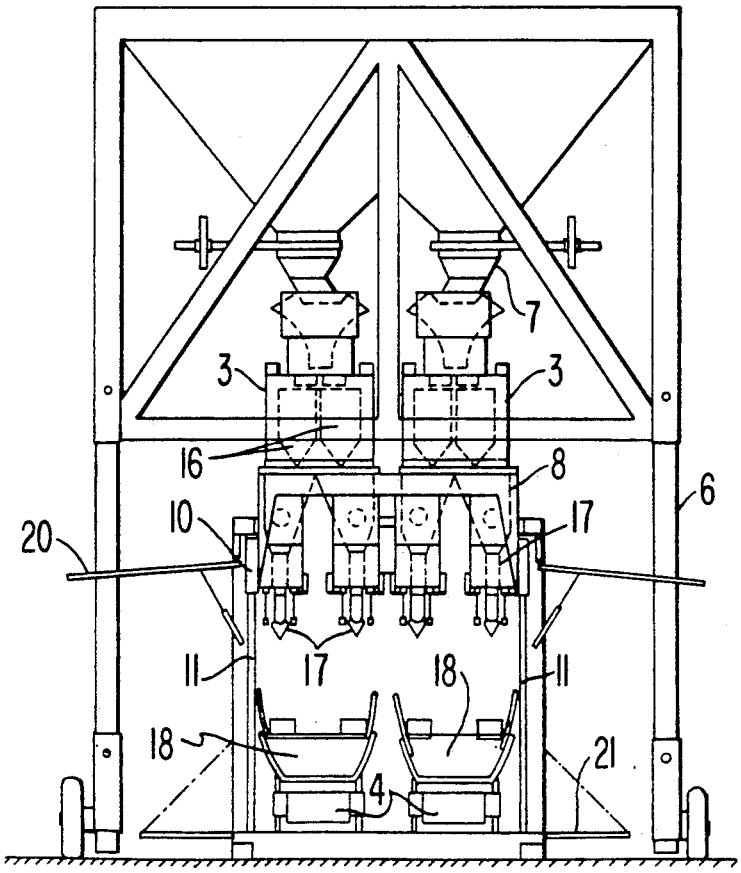
FIG. 4 is an end view of the modified bagging plant.

It should be added that the position of the support frame 8 is defined by the type of bag to be used. Thus, if open bags are to be filled, the support frame will be arranged in a position shown in FIG. 1, whereas if valved bags are filled the support frame will be arranged in a position as shown in FIGS. 3 and 4, to be discussed below. Also, the support frame is secured in its various positions to the framelike construction 2 by screwed connections (not shown).

The support frame according to the invention is not restricted to the examples shown in the drawings or explained above. Thus, it is possible to add to the columns extensions reaching above the top part of the support frame and also to use U-shaped instead of pipe-shaped casings. Further, it is possible to use telescopic casings attached to each of the corners, and the legs of the support frame may form inner pipes thereof. Further, sliding members or rollers may be used on the support frame.

Different arrangements may be employed for lowering and raising of the support frame 8. FIGS. 1 and 2 illustrate an arrangement including a chain 12 extending from the corners of the support frame 8 via freely running gears 14. The chain is pulled or activated by means of a hydraulic cylinder 13. FIGS. 3 and 4 illustrate another example where the support frame can be lowered and raised using a centrally located telescopic hydraulic system. A hydraulic lifting system is described, but if preferred, other practical lifting arrangements can be employed. Also, instead of the arrangement of the chain shown in FIGS. 1 and 2, one may use wires passed over freely suspended castors and pulled by suitable means such as a drum. Further, instead of employing a single telescopic hydraulic system as shown in FIGS. 3 and 4, four such units may be employed, wherein one unit is located at each corner of the support frame 8.

FIGS. 3 and 4 illustrate a system almost equivalent to the system of FIGS. 1 and 2, but FIGS. 3 and 4 illustrate a system which is modified for valved bags. The modification provides that the support frame 8 and the weighing and filling means 3 are arranged at higher positions to make room for a filling spout 17 and a turning hopper 18 for the bags. Because bagging valved bags requires longer filling time due to the filling pipe 17 than bagging open bags, each of the weighing and filling means 3 is provided with two weighing silos 16 and two corresponding filling pipes or spouts 17. Thus, the transport capacity has been doubled compared to what would have been possible with only one weighing silo and filling spout.

The framelike construction 2 can be provided with covers in the form of doors and/or trapdoors 19, 20, 21 for housing the packing apparatus when it is not in use. A second option is to provide parts of the sideports and roof with permanent covers. It should though be mentioned that it is most convenient if the largest possible proportion of the sides of the framelike construction are uncovered when the apparatus is in use. This will provide more flexible solutions with regard to the movability of the transport conveyors 4 out of the framelike construction to adapt the receiver system to a lorry, etc., on a quay.

The drawings show how the doors 19 can be used for closing end ports and the use of split trapdoors 20, 21 for covering of the sides. The trapdoors may be hinged to the framelike construction, and when the packing system is in use they may be doubled by turning them up against the roof, or against the working platform, see FIGS. 2 and 4. The framelike construction and the covers can be made of any suitable metal and have outer dimensional sizes and shapes corresponding to standard container dimensions. This however is not a necessary feature, because the packing system is very often transported by ships where the size is not critical and not by container-ships.

In one corner of the framelike construction there is a space or room for an electrical system which is connected to the weighing devices (not shown). Such room has a cooling apparatus to keep the temperature of the electrical apparatus at a constant level. The weighing and filling devices and the equipment in the framelike construction are well known and will not be described in more detail.

The operation of the packing system according to the invention now will be described. Free-flowing material such as fertilizer, grain, etc. is supplied to the hopper 1 by a grab or conveyor. The material is transported from the hopper via the flexible couplings 7 to the weighing and filling devices 3. Depending on the bag size, electronic weighing devices will provide a very accurate weighing of the material. Open bags are bagged (FIGS. 1 and 2) by supply from only a single outlet from each of the weighing and filling devices 3, and the bags are kept in position by a tightening means 15. After bagging is performed, the bags are dropped to the conveyor 4 and passed thereby to the respective sealing machine 5. The sealing machine 5 might be either an adhesive or a hot welding machine, depending on the type of bag. From the sealing machines the bags are transported to a lorry or to a suitable site for storage.

Valved bags are bagged as illustrated in FIGS. 3 and 4. As previously described, double weighing siloes 15 can be employed for each device 3, each silo 16 having a single corresponding filling spout. The bags are moved to the filling spouts and will alternately, as they are filled, drop to the respective transport conveyor 4. Because the valved bags are self-sealing, they can be directly transported to a waiting lorry or storage site.

We claim:

1. A mobile bagging apparatus for sealingly filling weighed amounts of free-flowing material into bags, said apparatus comprising:

a receiving assembly for receiving and for intermediate storage of free-flowing material;

at least one weighing and filling assembly for receiving material from said receiving assembly and for filling a weighed amount of the material into a bag;

at least one transport assembly for transporting filled bags from said weighing and filling assembly;

a frame construction supporting said weighing and filling assembly and said transport assembly;

means for mounting said weighing and filling assembly on said frame construction for vertical movement relative thereto between lower and upper positions whereat said weighing and filling assembly respectively is substantially within said frame construction and is at least partly above said frame construction;

support means, separate from and independent of said frame construction, for supporting said receiving assembly above said weighing and filling assembly for vertical adjustment relative thereto; and said frame construction and said weighing and filling assembly being isolated from vibrations and shocks imparted to said receiving assembly and said support means.

2. An apparatus as claimed in claim 1, wherein said mounting means comprises a support frame mounted on said frame construction for vertical movement relative thereto.

3. An apparatus as claimed in claim 2, wherein said support frame comprises a rectangular platform.

4. An apparatus as claimed in claim 2, further comprising guide assemblies guiding vertical movement of said support frame.

5. An apparatus as claimed in claim 3, wherein each said guide assembly comprises a vertical column member and a casing member connected to said support frame and movable along said column member.

6. An apparatus as claimed in claim 5, wherein said column member is supported on said frame construction.

7. An apparatus as claimed in claim 5, wherein said casing members are mounted on legs extending downwardly from said support frame.

8. An apparatus as claimed in claim 2, further comprising hydraulic means for moving said support frame vertically relative to said frame construction.

9. An apparatus as claimed in claim 8, wherein said hydraulic means comprises a telescopic hydraulic unit arranged centrally of said support frame.

10. An apparatus as claimed in claim 8, wherein said hydraulic means comprises a plurality of telescopic hydraulic units arranged at respective corners of said support frame.

11. An apparatus as claimed in claim 2, further comprising a chain or wire assembly for moving said support frame vertically relative to said frame construction.

12. An apparatus as claimed in claim 1, wherein said weighing and filling assembly includes an electronic weighing system.

13. An apparatus as claimed in claim 21, wherein said electronic weighing system is housed within a climate controlled space.

14. An apparatus as claimed in claim 1, further comprising at least one sealing assembly, supported by said frame construction, for sealing filled bags transported by said transport assembly.

15. An apparatus as claimed in claim 1, further comprising flexible coupling means connecting an outlet of said receiving assembly to an inlet of said weighing and filling assembly while substantially preventing transmission of vibrations and shocks therebetween.

* * * * *